US012460903B1

(12) United States Patent
Howe et al.

(10) Patent No.: US 12,460,903 B1
(45) Date of Patent: Nov. 4, 2025

(54) GUNSIGHT ILLUMINATION SYSTEM

(71) Applicant: HiViz, LLC, Laramie, WY (US)

(72) Inventors: Phillip D. Howe, Laramie, WY (US); Bradley R. Smith, Timnath, CO (US); Jason D. Webb, Laramie, WY (US); Frederick T. Karl, West Linn, OR (US)

(73) Assignee: HiViz Group, Inc., Laramie, WY (US)

( * ) Notice: Subject to any disclaimer, the term of this patent is extended or adjusted under 35 U.S.C. 154(b) by 0 days.

(21) Appl. No.: 19/018,251

(22) Filed: Jan. 13, 2025

(51) Int. Cl.
*F41G 1/34* (2006.01)

(52) U.S. Cl.
CPC ..... *F41G 1/345* (2013.01)

(58) Field of Classification Search
CPC ..... F41G 1/32; F41G 1/34; F41G 1/345
USPC ..... 42/131–132
See application file for complete search history.

(56) References Cited

U.S. PATENT DOCUMENTS

| | | | |
|---|---|---|---|
| 815,090 | A | 3/1906 | Hukill |
| 898,531 | A | 9/1908 | Tufts |
| 1,292,211 | A | 1/1919 | Young |
| 1,346,303 | A | 7/1920 | Trevor et al. |
| 1,363,553 | A | 12/1920 | Barringer |
| 1,818,381 | A | 8/1931 | Caruth |
| 2,706,335 | A | 4/1955 | Munsey |
| 2,970,380 | A | 2/1961 | Hill |
| 3,098,303 | A | 7/1963 | Plisk |
| 3,121,163 | A | 2/1964 | Rickert |
| 3,192,632 | A | 7/1965 | Von Stavenhagen |
| 3,362,074 | A | 1/1968 | Luebkeman et al. |
| 3,641,676 | A | 2/1972 | Knutsen et al. |
| 3,645,635 | A | 2/1972 | Steck |
| 3,678,590 | A | 7/1972 | Hayward |
| 3,698,092 | A | 10/1972 | Rosenhan |
| 3,700,339 | A | 10/1972 | Steck, III |
| 3,813,790 | A | 6/1974 | Kaltmann |
| 3,886,667 | A | 6/1975 | Rueb |
| 3,905,708 | A | 9/1975 | Steck, III |
| 3,949,482 | A | 4/1976 | Ross |
| 4,070,763 | A | 1/1978 | Carts, Jr. |
| 4,136,963 | A | 1/1979 | Budden et al. |
| 4,495,705 | A | 1/1985 | Kowalski et al. |
| 4,536,965 | A | 8/1985 | Tildeblad |

(Continued)

FOREIGN PATENT DOCUMENTS

| | | |
|---|---|---|
| AT | 507403 | 4/2010 |
| CH | 667150 | 9/1988 |

(Continued)

OTHER PUBLICATIONS

PCT International Patent Application No. PCT/US19/26809, International Search Report and Written Opinion of the International Searching Authority dated Oct. 3, 2019, 17 pages.

(Continued)

*Primary Examiner* — Troy Chambers
*Assistant Examiner* — Benjamin S Gomberg
(74) *Attorney, Agent, or Firm* — Craig R. Miles; CR MILES P.C.

(57) ABSTRACT

A weapon sight comprising a light emission assembly including a blade having a viewable illuminated aiming indicium which varies in light intensity or light color automatically based on corresponding ambient light intensity or by manually selected switch sequence pattern.

39 Claims, 12 Drawing Sheets

(56) References Cited

U.S. PATENT DOCUMENTS

| | | | | |
|---|---|---|---|---|
| 4,574,335 | A * | 3/1986 | Frimer | F41G 1/32 362/110 |
| 4,745,686 | A | 5/1988 | Willis | |
| 4,745,698 | A | 5/1988 | Schwulst | |
| 4,806,007 | A | 2/1989 | Bindon | |
| 4,877,324 | A | 10/1989 | Hauri et al. | |
| 5,065,519 | A | 11/1991 | Bindon | |
| 5,279,061 | A | 1/1994 | Betz et al. | |
| 5,359,800 | A | 11/1994 | Fisher | |
| 5,440,458 | A | 8/1995 | Volk | |
| 5,500,911 | A | 3/1996 | Roff | |
| 5,548,493 | A | 8/1996 | Young | |
| 5,560,113 | A | 10/1996 | Simo et al. | |
| 5,638,604 | A | 6/1997 | Lorocco | |
| 5,735,070 | A * | 4/1998 | Vasquez | F41G 1/345 42/132 |
| 5,752,761 | A | 5/1998 | Pietruczynik et al. | |
| 5,822,872 | A | 10/1998 | Waki | |
| 5,850,700 | A | 12/1998 | Capson et al. | |
| 5,862,618 | A | 1/1999 | Brown | |
| 5,878,503 | A | 3/1999 | Howe et al. | |
| 5,926,963 | A | 7/1999 | Knight | |
| 5,930,906 | A | 8/1999 | Howe et al. | |
| 5,956,854 | A | 9/1999 | Lorocco | |
| 5,966,825 | A * | 10/1999 | Biemont | F41G 1/545 42/136 |
| 6,005,024 | A | 12/1999 | Anders et al. | |
| 6,014,830 | A | 1/2000 | Brown et al. | |
| 6,035,539 | A | 3/2000 | Hollenbach et al. | |
| 6,058,615 | A | 5/2000 | Uhlmann et al. | |
| 6,058,616 | A | 5/2000 | Bubits | |
| 6,122,833 | A | 9/2000 | Lorocco | |
| 6,216,351 | B1 | 4/2001 | Flubacher et al. | |
| 6,216,352 | B1 | 4/2001 | Lorocco | |
| 6,233,836 | B1 | 5/2001 | Uhlmann | |
| 6,245,433 | B1 | 6/2001 | Nakamura et al. | |
| 6,345,470 | B1 | 2/2002 | Slaght et al. | |
| 6,358,855 | B1 | 3/2002 | Ramachandran et al. | |
| 6,360,471 | B1 | 3/2002 | Stein | |
| 6,360,472 | B1 | 3/2002 | Lorocco | |
| 6,375,864 | B1 | 4/2002 | Phillips et al. | |
| 6,385,855 | B1 | 5/2002 | Tymianski | |
| 6,421,946 | B1 | 7/2002 | LoRocco | |
| 6,446,377 | B1 | 9/2002 | Hollenbah et al. | |
| 6,571,482 | B1 | 6/2003 | Tymianski | |
| 6,581,317 | B1 | 6/2003 | Slates | |
| 6,596,074 | B2 | 7/2003 | Pomeroy | |
| 6,604,315 | B1 | 8/2003 | Smith et al. | |
| 6,678,987 | B2 | 1/2004 | Howe | |
| 6,684,551 | B2 | 2/2004 | Howe | |
| 7,238,301 | B2 | 7/2007 | Huang et al. | |
| 7,338,877 | B1 | 3/2008 | Meyer et al. | |
| 7,451,566 | B1 | 11/2008 | Price | |
| 7,562,486 | B2 | 7/2009 | LoRocco | |
| 7,627,976 | B1 | 12/2009 | Olson | |
| 7,739,825 | B2 | 6/2010 | LoRocco | |
| 7,908,783 | B2 | 3/2011 | Howe et al. | |
| 8,161,675 | B2 | 4/2012 | Sne et al. | |
| 8,245,433 | B1 | 8/2012 | Smith | |
| 8,371,059 | B1 * | 2/2013 | Tillinghast | F41G 3/18 42/132 |
| D679,359 | S | 4/2013 | Adock, Jr. | |
| 8,425,063 | B2 | 4/2013 | Buckingham et al. | |
| 8,438,775 | B2 | 5/2013 | Howe et al. | |
| 8,635,800 | B2 | 1/2014 | Glimpse et al. | |
| 8,635,801 | B2 | 1/2014 | Glimpse et al. | |
| D700,268 | S | 2/2014 | Hormberg | |
| 8,925,237 | B2 | 1/2015 | Howe et al. | |
| 8,997,393 | B2 | 4/2015 | Bar Yona | |
| 9,212,867 | B2 * | 12/2015 | Patterson | H05B 45/12 |
| 9,638,492 | B2 * | 5/2017 | Jones | F41G 1/01 |
| 9,644,921 | B1 | 5/2017 | LoRocco et al. | |
| 9,759,519 | B2 | 9/2017 | Hancosky | |
| 9,869,525 | B1 | 1/2018 | Howe et al. | |
| 10,088,274 | B2 | 10/2018 | Howe et al. | |
| 10,180,306 | B2 | 1/2019 | Ben Zion et al. | |
| 10,386,157 | B2 | 8/2019 | Plummer | |
| 10,578,401 | B2 | 3/2020 | Ben Zion et al. | |
| 10,753,707 | B2 | 8/2020 | Howe et al. | |
| 10,760,877 | B2 | 9/2020 | Howe et al. | |
| 10,837,737 | B1 * | 11/2020 | Wright | F41G 1/08 |
| 11,243,048 | B1 * | 2/2022 | Bryan | F41G 1/36 |
| 11,268,787 | B1 | 3/2022 | Bernkrant et al. | |
| 11,530,898 | B2 | 12/2022 | Howe et al. | |
| 12,007,201 | B2 | 6/2024 | Howe et al. | |
| 2006/0123687 | A1 | 6/2006 | Howe et al. | |
| 2007/0107292 | A1 | 5/2007 | Bar-Yona et al. | |
| 2008/0184609 | A1 | 8/2008 | Schulst | |
| 2009/0013581 | A1 | 1/2009 | LoRocco | |
| 2010/0064581 | A1 | 3/2010 | Johnson | |
| 2011/0107650 | A1 | 5/2011 | Howe et al. | |
| 2011/0314721 | A1 | 12/2011 | Lamb | |
| 2012/0151817 | A1 | 6/2012 | Howe et al. | |
| 2012/0186129 | A1 | 7/2012 | Sne et al. | |
| 2012/0198750 | A1 | 8/2012 | Mansfield | |
| 2013/0097881 | A1 | 4/2013 | Profos | |
| 2013/0255129 | A1 | 10/2013 | Curry | |
| 2014/0096430 | A1 | 4/2014 | Kruse | |
| 2015/0153136 | A1 | 6/2015 | Howe et al. | |
| 2016/0091281 | A1 * | 3/2016 | Gwillim, Jr. | F41G 1/345 29/401.1 |
| 2016/0102942 | A1 | 4/2016 | Abo | |
| 2017/0146318 | A1 * | 5/2017 | Plummer | F41G 1/345 |
| 2018/0045487 | A1 | 2/2018 | Abo | |
| 2018/0053575 | A1 | 2/2018 | Karchon et al. | |
| 2018/0231350 | A1 * | 8/2018 | Howe | F41G 1/14 |
| 2019/0107368 | A1 * | 4/2019 | Ben Zion | F41G 1/10 |
| 2020/0292274 | A1 | 9/2020 | Marelin | |
| 2021/0108886 | A1 | 4/2021 | Howe et al. | |
| 2021/0164759 | A1 * | 6/2021 | Genna | F41G 1/02 |
| 2022/0113116 | A1 | 4/2022 | Rohrer | |

FOREIGN PATENT DOCUMENTS

| | | |
|---|---|---|
| EP | 0254675 | 1/1988 |
| EP | 3660442 B1 | 9/2021 |
| GB | 1532090 | 11/1978 |
| WO | WO2006/111813 | 10/2006 |
| WO | WO2010/034458 | 4/2010 |
| WO | WO2011/067291 | 6/2011 |
| WO | WO2019/209535 | 10/2019 |

OTHER PUBLICATIONS

PCT International Patent Application No. PCT/US23/25821, International Search Report and Written Opinion of the International Searching Authority dated Apr. 3, 2024, 12 pages.

U.S. Appl. No. 16/147,307, Office Action mailed Sep. 17, 2019.

U.S. Appl. No. 17/845,529, Office Action mailed Dec. 8, 2023.

U.S. Appl. No. 15/953,374, Office Action mailed Oct. 30, 2019.

Aro-Tek Ltd. Tri-Lite Day/Night Sight, Catalog, 1997, 3 total pages.

MB-MICROTEC. Tactical Lynx, on-line catalog, www.mbmicrotec.com, originally downloaded May 31, 2011, 3 total pages.

MEPROLIGHT. This backup plan is always in sight. Overview. Website, https://www.meprolight.com/product-ft-bullseye/, originally downloaded Nov. 16, 2021, 2 pages.

Optics planet.com. Sig Sauer X-RAY1 Enhanced Day Sight Set, No. 6. Website, https://www.opticsplanet.com/sig-sauer-x-ray1-enhanced-day-sight-set.html, originally downloaded Jun. 29, 2022, 3 pages.

Personal Defense World. Truglo Introduces The new Brite-Site TFX Handgun Sight. Website, http://www.personaldefenseworld.com, originally downloaded Apr. 22, 2015, 5 pages total.

Truglo. Fat•Bead™. Website, https://www.truglo.com/fat-bead/, originally downloaded Jul. 19, 2023, 4 pages.

Truglo. TFX™ Tritium/Fiber-Optic Day/Night Sights. Website, http://www.truglo.com, originally downloaded Mar. 20, 2015, 1 page.

(56) References Cited

OTHER PUBLICATIONS

Truglo. Tru•Bead™ universal shotgun sights. Website, https://www.truglo.com/tru-bead-universal-shotgun-sights/ originally downloaded Jul. 19, 2023, 4 pages.

* cited by examiner

GUNSIGHT ILLUMINATION SYSTEM

I. FIELD OF THE INVENTION

A weapon sight comprising a light emission assembly including a blade having a viewable illuminated aiming indicium which varies in light intensity or light color automatically based on corresponding ambient light intensity or by manually by selected switch sequence pattern.

II. BACKGROUND OF THE INVENTION

Certain conventional weapon sights use light gathering elements such as optical fiber(s), fluorescent fibers, or the like, to transmit ambient light to one or both ends to provide an aiming indicium useful in aiming a weapon. Improvements have been made over time to locate an artificial light source (such as tritium gas-filled, thin glass capsules whose inner surfaces are coated with a phosphor, light emitting diodes, or like) adjacent the external surfaces of the light gathering fibers to provide an aiming indicium useful in aiming the weapon even in low ambient light or darkness. For example, U.S. Pat. Nos. 6,216,352 and 6,122,833 each describe a sight for weapons which includes an elongated optical fiber of light gathering plastic having a first end at which light is emitted to provide an aiming indicium and location of an elongated, phosphorescent, light-emitting element disposed adjacent the outer surface of the elongated optical fiber, or as to certain embodiments, at the transverse end wall defining the second end of the elongated optical fiber.

However, there are certain disadvantages with these types of conventional weapon sights to achieve a useful luminous intensity or light color of the aiming indicium. In certain instances, conventional light gathering elements can have an overall length which acts to reduce light intensity of the aiming indicia. The longer the light gathering element the greater the attenuation losses, due to transmissivity, refraction, and reflection of light. In other instances, conventional weapon sights which locate a tritium capsule adjacent an end of a light gathering element have a greater overall length which acts to further exacerbate attenuation losses which reduce light intensity of the aiming indicium. In other instances, conventional weapon sights may afford a light intensity of the aiming indicium that remains consistent regardless of the ambient light intensity, and thus, the light intensity of the aiming indicium can be insufficient in bright ambient light and overly sufficient in dim light. In other instances, conventional weapon sights may afford a light color of the aiming indicium that remains consistent regardless of the ambient light intensity or ambient light color, and thus, the aiming indicium may be more visible in bright ambient light and less visible in dim ambient light or vice versa.

Accordingly, it would be useful and there would be substantial advantages in a weapon sight which automatically adjusts light intensity and/or light color of the aiming indicium based on the ambient light intensity and/or ambient light color or allows adjustment of light intensity and/or light color of the aiming indicium based on manually selected switch sequence patterns.

III. SUMMARY OF THE INVENTION

A broad object of embodiments of the invention can be to provide weapon sight and methods of making a weapon sight including: a blade including a light source disposed in the blade operable to emit light through a blade aperture; a photosensor operable to generate a photosensor signal which varies based on sensed ambient light; a switch operable to generate switch sequence patterns, and a microprocessor electrically connected to the photosensor and the light source, wherein the microprocessor operates a light emitter driver to automatically adjust emitted light intensity and/or emitted light color generated by the light source based on sensed ambient light, and a switch sequence pattern translator which converts user entered switch sequence patterns to logical steps to actuate different operational modes of the weapon sight to adjust emitted light intensity and/or emitted light color of light emitted by the light source.

Another broad object of particular embodiments of the invention can be to provide a weapon sight and methods of making a weapon sight including: a blade having a blade external surface and a blade internal surface delimiting a hollow interior; a blade aperture communicating between the blade internal surface and the blade external surface; a light pipe disposed within the hollow interior of the blade adjacent the blade aperture; and a tritium capsule disposed in the hollow interior of the blade adjacent the light pipe, wherein the tritium capsule emits light to illuminate the light pipe adjacent the blade aperture.

Another broad object of particular embodiments of the invention can be to provide a weapon sight and methods of making a weapon sight including: a blade including blade external surface and a blade internal surface delimiting a hollow interior; a blade aperture communicating between the blade internal surface and a blade external surface; a light pipe disposed within the hollow interior of the blade, the light pipe having a light pipe length disposed between a light pipe first end and a light pipe second end, the light pipe first end disposed adjacent the blade aperture; one or more light emitters disposed proximate the light pipe second end, the light emitter operable to emit light to illuminate the light pipe first end; a photosensor positioned to sense ambient light, the photosensor operable to generate a photosensor signal which varies based on ambient light intensity; and a microprocessor including a light emitter driver electrically connected to the light emitter, the light emitter driver operable to adjust light intensity and/or light color emitted by the one or more light emitters based on sensed ambient light intensity.

Another broad object of particular embodiments of the invention can be to provide a weapon sight and methods of making a weapon sight including: a blade including blade external surface and a blade internal surface delimiting a hollow interior; a blade aperture communicating between the blade internal surface and a blade external surface; one or more light emitting diodes disposed within the hollow interior of the blade sight, the light emitting diode operable to emit light through the blade aperture; a photosensor positioned to sense ambient light, the photosensor generates a photosensor signal which varies based on ambient light intensity; a microprocessor including a light emitting diode driver electrically connected to the one or more light emitting diodes, the light emitting diode driver operable to adjust light intensity and/or light color emitted by the one or more light emitting diodes based on the ambient light intensity.

Another broad object of particular embodiments of the invention can be to provide a weapon sight and methods of making a weapon sight including: a blade including blade external surface and a blade internal surface delimiting a hollow interior; a blade aperture communicating between the blade internal surface and a blade external surface; a light source disposed in the hollow interior of the blade operable to emit light viewable through the blade aperture, the light source comprises a light emitter or a light pipe coupled to a light emitter; a switch operable to generate a switch sequence pattern; and a microprocessor including: a light emitter driver electrically connected to the light emitter, the light emitter driver operable to adjust light intensity and/or light color emitted by the light emitter; and a switch sequence pattern translator which converts the switch sequence pattern into logical steps to operate the light emitter driver to adjust light intensity and/or light color emitted by the light emitter.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
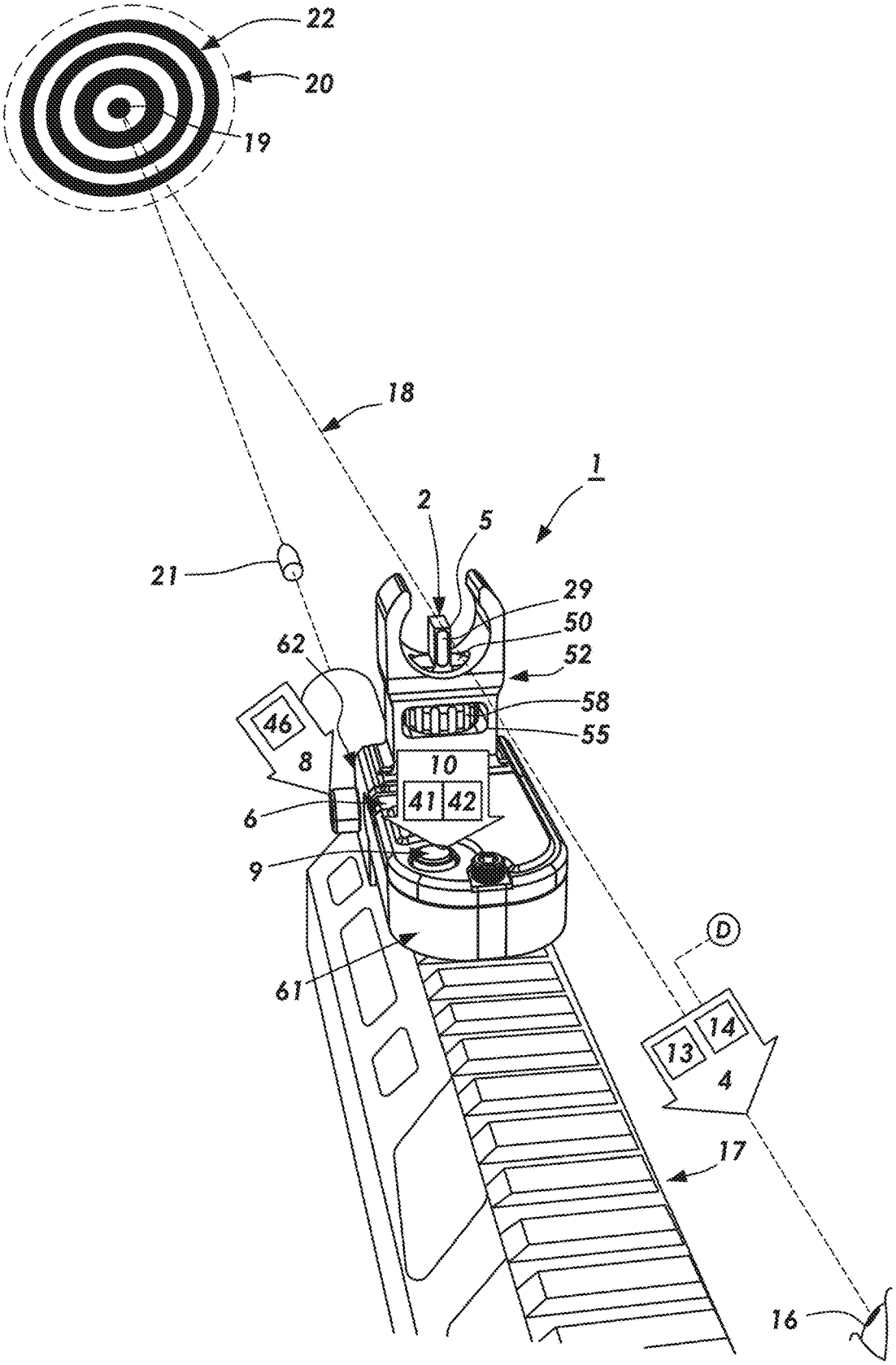
FIG. 1 is an illustration of a method of aiming an embodiment of an inventive weapon sight.
Figure 2:
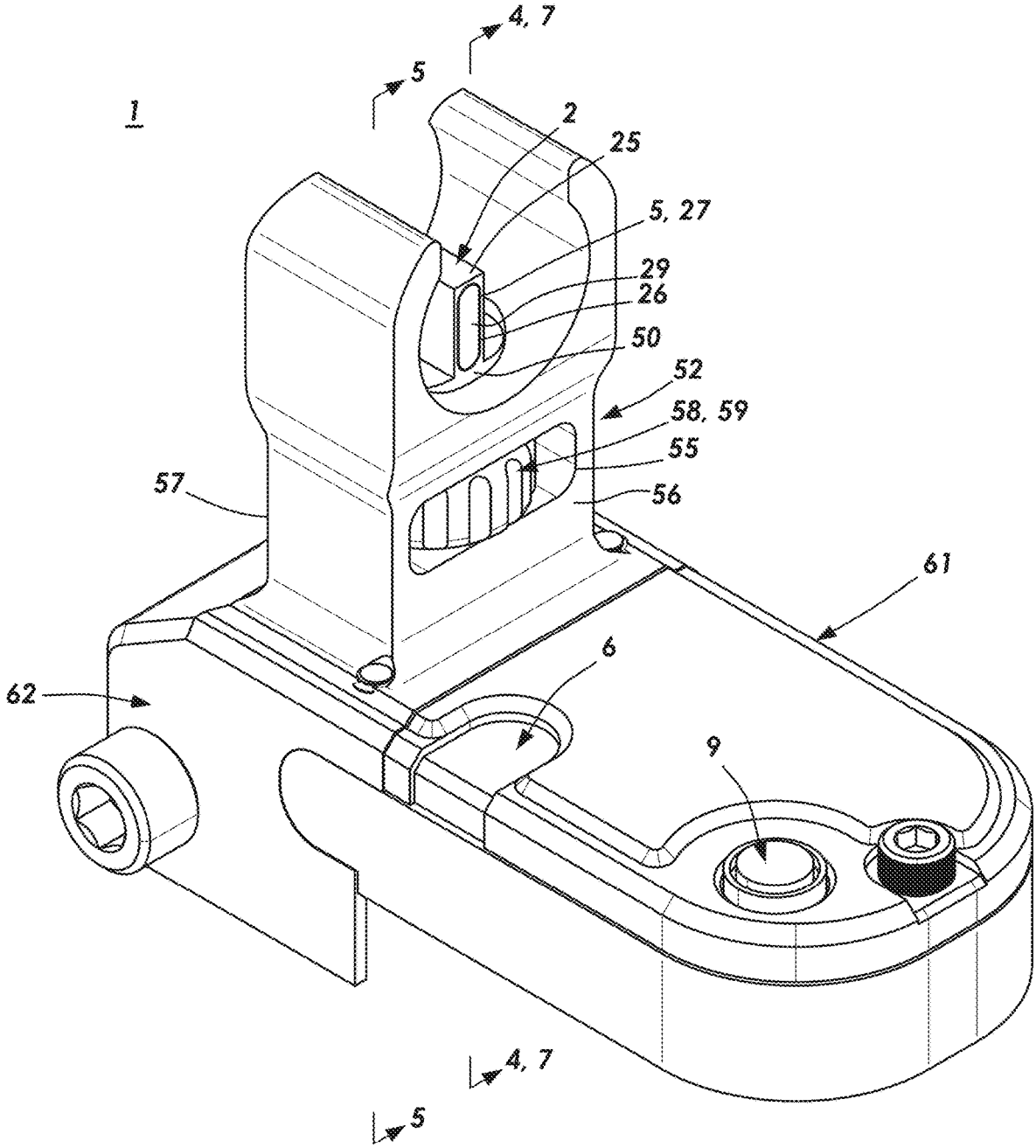
FIG. 2 is a front perspective view of a particular embodiment of the inventive weapon sight.

Generally, referring to FIGS. 1 through 19 which depict embodiments of a weapon sight (1) and methods of making and using a weapon sight (1) having one or more of: a blade (2), a light source (3) disposed in the blade (2) operable to emit light (4) through a blade aperture (5), a photosensor (6) operable to generate a photosensor signal (7) which varies based on sensed ambient light (8), a switch (9) operable to generate switch sequence patterns (10), and a microprocessor (11) electrically connected to the photosensor (6) and the light source (3), wherein the microprocessor (11) operates a light emitter driver (12) to automatically adjust emitted light intensity (13) and/or emitted light color (14) generated by the light source (3) based on sensed ambient light (8), and a switch sequence pattern translator (15) which converts user (16) entered switch sequence patterns (10) to logical steps to actuate different operational modes of the weapon sight (1) to adjust emitted light intensity (13) and/or emitted light color (14) emitted by the light source (3).

Now, with primary reference to FIG. 1, which depicts a method of using the inventive weapon sight (1), in which a user (16) aligns a line of sight with the front and rear sights of the weapon (17), forming a sight axis (18) and in turn producing a point of aim (19) within a field of view (20). In practice, the user (16) centers the blade (also referred to as a "post") of the front sight in the notch of the rear sight with the tops of both sights level. Embodiments of the inventive weapon sight (1) can be adapted for use with a numerous and wide variety of weapons (17) to aim the weapon (17) to direct energy, project beams, launch projectiles, such as bullets, pellets, or BBs, or the like whether each individually or in various combinations (individually or collectively "projectile(s)" (21) at the point of aim (19) on a target (22). The term "weapon" (17) is not intended to be limiting, but rather to broadly encompass devices which can be aimed for military, sporting, hobby or other applications. As illustrative examples, the weapons (17) to which embodiments of the inventive weapon sight (1) can be adapted include: handguns, rifles, bows, shot guns, BB guns, pellet guns, laser weapons, and energy weapons. The target (22) may be any object at which the weapon (17) can be aimed to receive the projectile(s) (21), including inanimate and animate objects.

Again, with primary reference to FIGS. 1 through 19, embodiments of the inventive weapon sight (1) can include a blade (2) including a blade internal surface (23) defining a hollow interior (24) and a blade external surface (25). The blade external surface (25) can have a blade front face (26) viewed by the user (16). The blade front face (26) can vary in width and height with a wider blade (2) generally preferred for close-range shooting and a narrower blade for longer-range accuracy. Typically, the blade front face (26) has a width in the range of about 0.050 inches to about 0.080 inches and a height in the range of about 0.100 inches to 0.150 inches. A blade aperture (5) can be disposed in the blade front face (26) communicating between the blade internal surface (23) and the blade external surface (25). The aperture periphery (27) can delimit an aperture open area (28) of varying configurations depending on the application. In particular embodiments, the aperture periphery (27) can delimit a rectangle or stadium configuration, which substantially fills the blade front face (26). An aperture lens (29) can be disposed in the blade aperture (5). The aperture lens (29) can be made of a material allowing passage of emitted light (4).

Now, with primary reference to FIGS. 1 through 7, a light source (3) can be disposed in the hollow interior (24) of the blade (2) operable to emit light (4) viewable through the blade aperture (5). In particular embodiments, the light source (3) can comprise at least one light emitter (30) supported inside the hollow interior (24) of the blade (2) to emit light (4) directly through the blade aperture (5). The light emitter (30) can be a solid-state light emitting element formed from organic or inorganic semiconductor materials. As illustrative examples, the light emitter (30) can be a light emitting diode ("LED") (30') including all types of semiconductor diode devices that are capable of receiving an electrical signal and producing a responsive output of electromagnetic energy. Thus, the term "LED" should be understood to include light emitting diodes (30') of all types, light emitting polymers, organic diodes, and the like; however, the illustrative example of the use of LED light emitters (30') is not intended to preclude other types of light emitters (30) adapted for, capable of, or configured to emit light (4) within a predetermined or selected segment of the electromagnetic spectrum (31). As illustrative examples, the light emitting diode (30') can be configured to emit light (4) having a pre-determined or user selected wavelength (32) within a range of about 100 nanometers to about 1 millimeter. In particular embodiments, the one or more light emitting diodes (30') can be configured to emit light having a pre-determined or user (16) selected emitted light color (14), as an example a green color (G) or a red color (R). The light emitting diode (30') can be configured to emit light (4) having a pre-determined or user selected emitted light intensity (13).

In other embodiments, the light emitter (30) can emit light (4) internally reflected through a light pipe (33) to indirectly emit light through the blade aperture (5). The term "light pipe" as used herein includes constructional forms of one or more light conductive materials fabricated, formed, extruded, cast, molded, or by other process(es) that provides a configuration having an light pipe external surface (34) which receives an amount of emitted light (4) from the light emitter (30) and conducts the emitted light (4) internally, in whole or in part, or as modified by any dopants (35) included in the light conductive material of the light pipe (33) to be emitted at a light pipe end (36). Various light conductive materials can be utilized to produce the light pipe (33), including, as illustrative examples, extruded, molded, cast, or fabricated plastic such as: polystyrene, polycarbonate, polyvinylchloride, TEFLON®, nylon, polystyrene, polyurethane, acrylic, polyethylene teraphthalate, polyethersulfone, polymethylmethacrylate, separately or in various combinations thereof. Particular embodiments of the light pipe (33), as a consequence of the type of light conductive material or the constructional form of the light pipe (33) (or as a consequence of both), can achieve total internal reflection, substantial internal reflection, or the desired level of internal reflection of the emitted light (4) incident on the light pipe external surface (34) of the light pipe (33) to allow transmission of all, substantially all, or the desired amount of light (4) to the light pipe end (36) of the light pipe (33).

As to other particular embodiments, the light pipe (33) can be further surrounded by a plastic cladding material (such as polystyrene, polymethylmethacrylate, or fluoropolymer) which reflects the light (4) within the light conductive material for transmission of the light (4) to the light pipe end (36) of the light pipe (33). The length, cross sectional configuration (such as circular, square, rectangular, oval, triangular, or the like), external surface area, thickness, width, or the amount of one or more dopants (35) within the light conductive material can be adjusted depending on the desired brightness, color, or amount of light (4) to be transmitted in the light pipe (33) and emitted from the light pipe end (36).

The light conductive materials of embodiments of the light pipe (33) can further include or contain one or more dopants (35). The term "dopant (35)" as used herein means one or a plurality of similar or dissimilar trace impurity element(s) included separately or in various permutations and combinations in the light conductive material at concentrations such that the light (4) in the spectrum received by the light pipe external surface (34) and transmitted within the light pipe (33), whether in whole or in part, activates the one or more dopant(s) (35) which in turn fluoresce in a corresponding one or more wavelengths delivered to the light pipe end (36) of the light pipe (33) as a color perceivable to the user (16).

The light conductive materials of embodiments of the light pipe (33) can further include or contain one or more colorants (37). The colorant (37) can be combined in various permutations and combinations with the light conductive material and one or more dopants (35) to achieve a desired color and fluorescence of the light pipe (33). Combinations of colorant(s) (37) with dopant(s) (35) suitable for use with embodiments of the invention can be obtained from ColorChem International Corporation, 8601 Dunwoody Place, Atlanta, Georgia; Keystone Aniline Corporation, 2501 West Fulton Street, Chicago, Illinois; or Sun Chemical Corporation, 25 Waterview Boulevard, Persippany, New Jersey.

Again, with primary reference to FIGS. 1 through 7, in particular embodiments, the light pipe (33) disposed within the hollow interior (24) of the blade (2) can have a light pipe length (38) disposed between a light pipe first end (39) viewable through the blade aperture (5) and a light pipe second end (40). A light emitter (30) can be disposed proximate the light pipe second end (40). The light emitter (30) can be operated to emit light (4) to illuminate the light pipe first end (39) which can be viewed through the blade aperture (5). The at least one light emitter (30) can be adapted to emit light (4) within a predetermined or user (16) selected segment of the electromagnetic spectrum (31), or at one or more pre-determined or user selected wavelength frequencies (41) or pre-determined or user (16) selected wavelength amplitudes (42), and combinations thereof.

Now, with primary reference to FIGS. 3 through 9, in particular embodiments, the light emitter (30) can comprise a chip on a board ("COB") LED (30'). The printed circuit board ("PCB") (43) can be supported within the weapon sight (1) to carry one or a plurality of light emitters (30). As one illustrative example, the PBC (43) can carry a plurality of controllable LED light emitters (30') (as examples: red (R), green (G) and blue (B) LEDs), or a controllable LED light emitter(s) operable to emit light at one or more wavelengths within a range of about 100 nanometers to about 1 millimeter. The one or the plurality of light emitters (30) mounted on the PBC (43) can emit light (4) proximate the light pipe second end (40) and conducted to the light pipe first end (39) to emit light (4) through the blade aperture (5).

Figure 3:
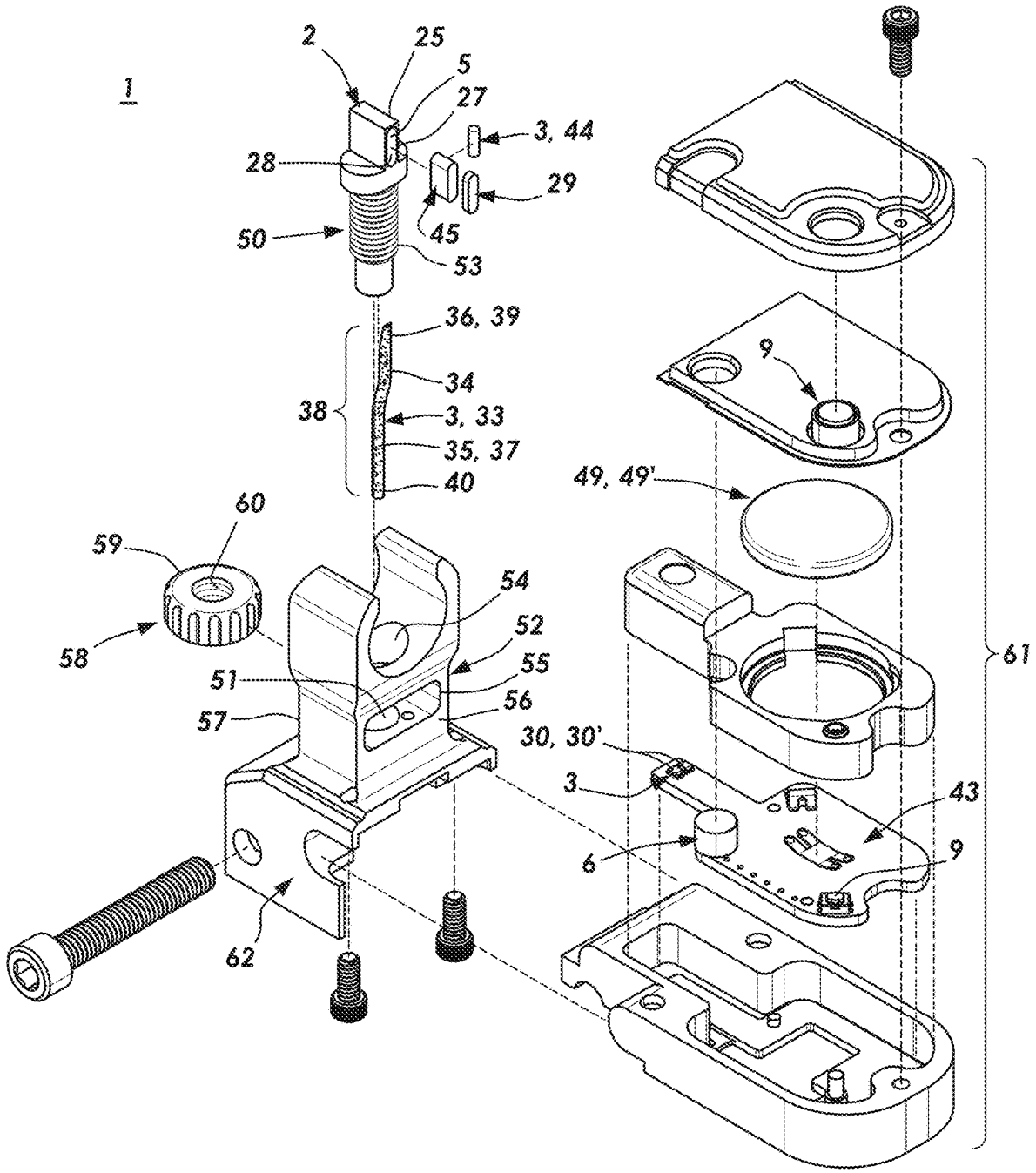
FIG. 3 is an exploded view of a particular embodiment of the inventive weapon sight as depicted in FIG. 2.
Figure 4:
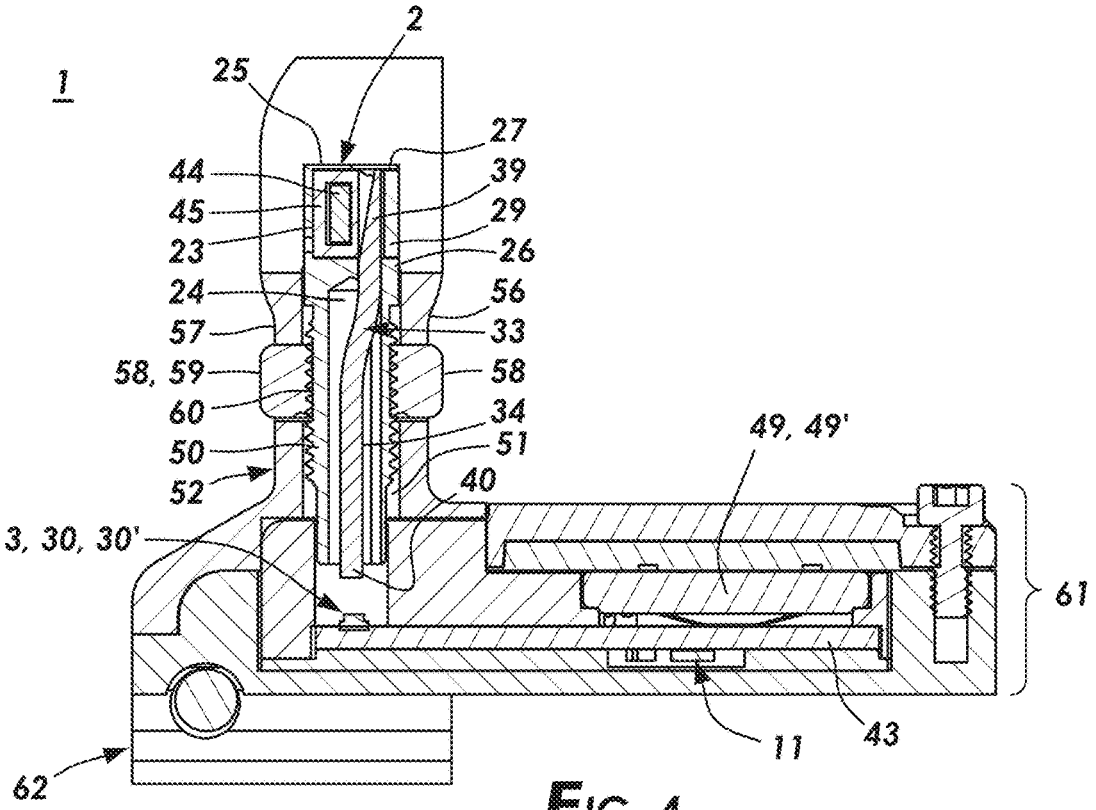
FIG. 4 is a cross section view 4-4 as depicted in FIG. 2.
Figure 5:
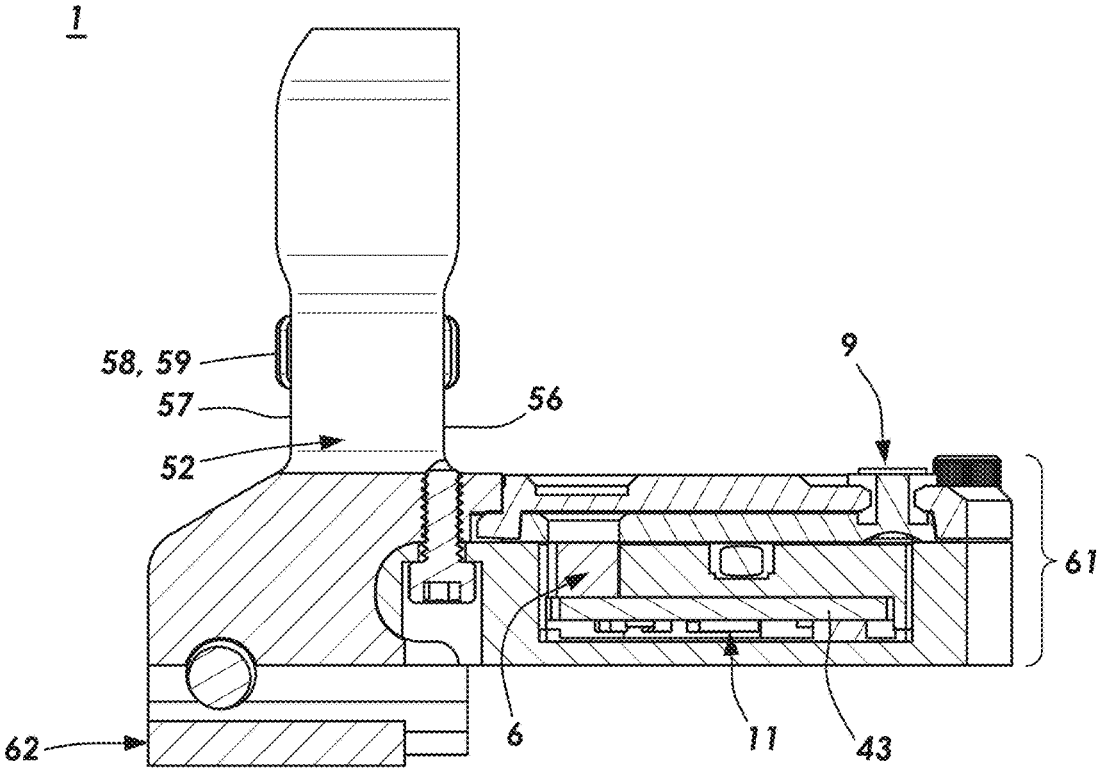
FIG. 5 is a cross section view 5-5 as depicted in FIG. 2.
Figure 6:
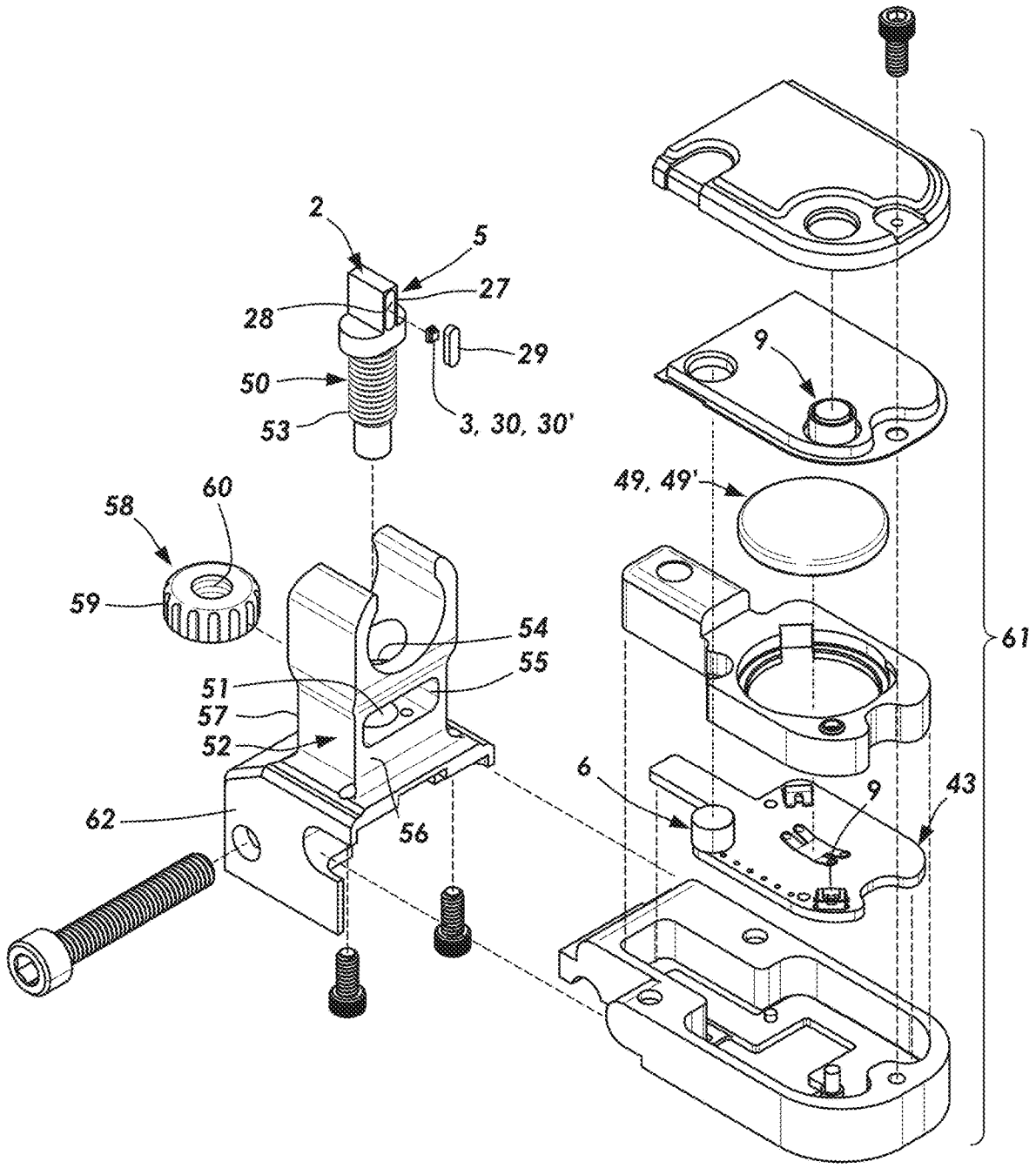
FIG. 6 is an exploded view of a particular embodiment of the inventive weapons sight as depicted in FIG. 2.
Figure 7:
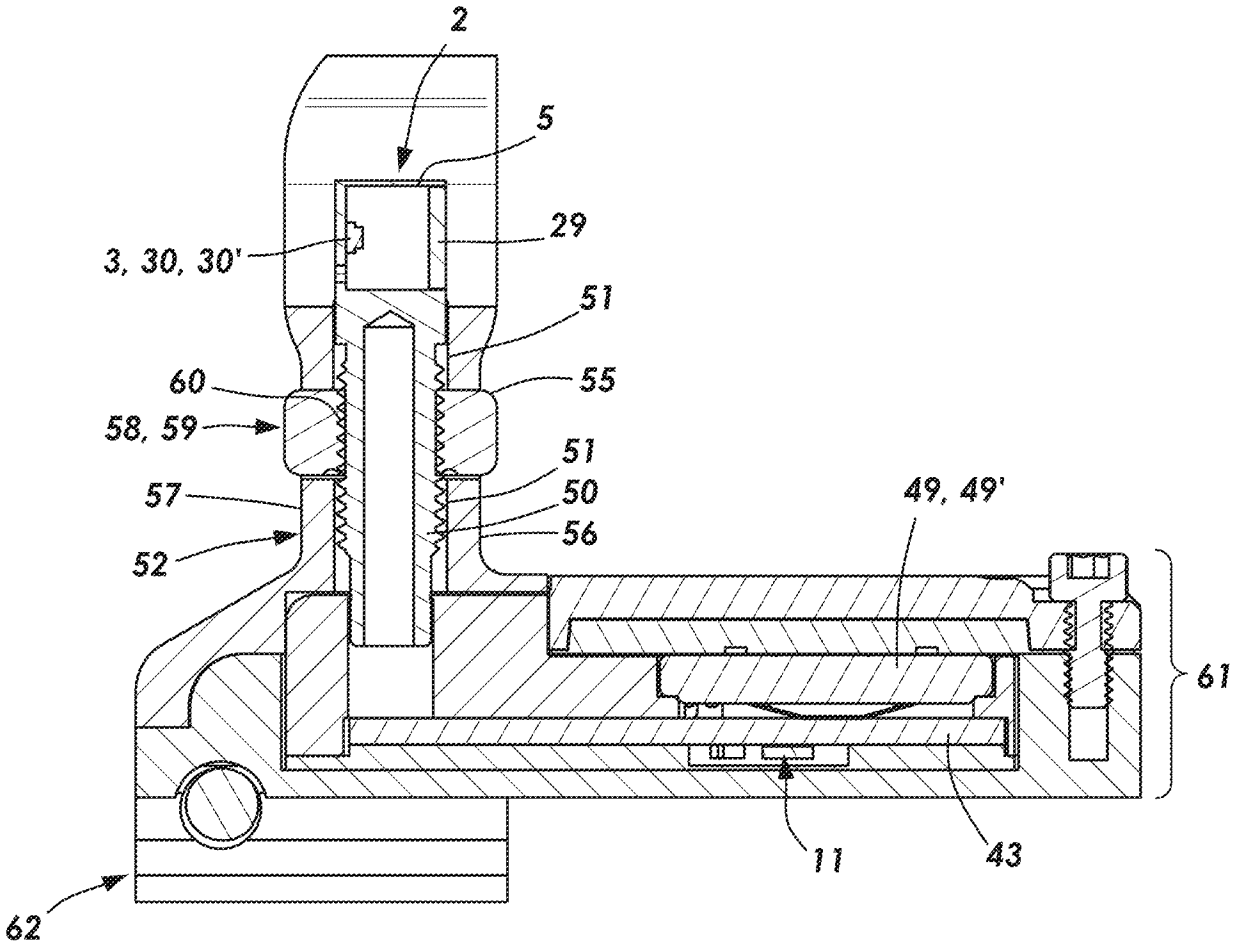
FIG. 7 is a cross section view 7-7 as depicted in FIG. 2.
Figure 8:
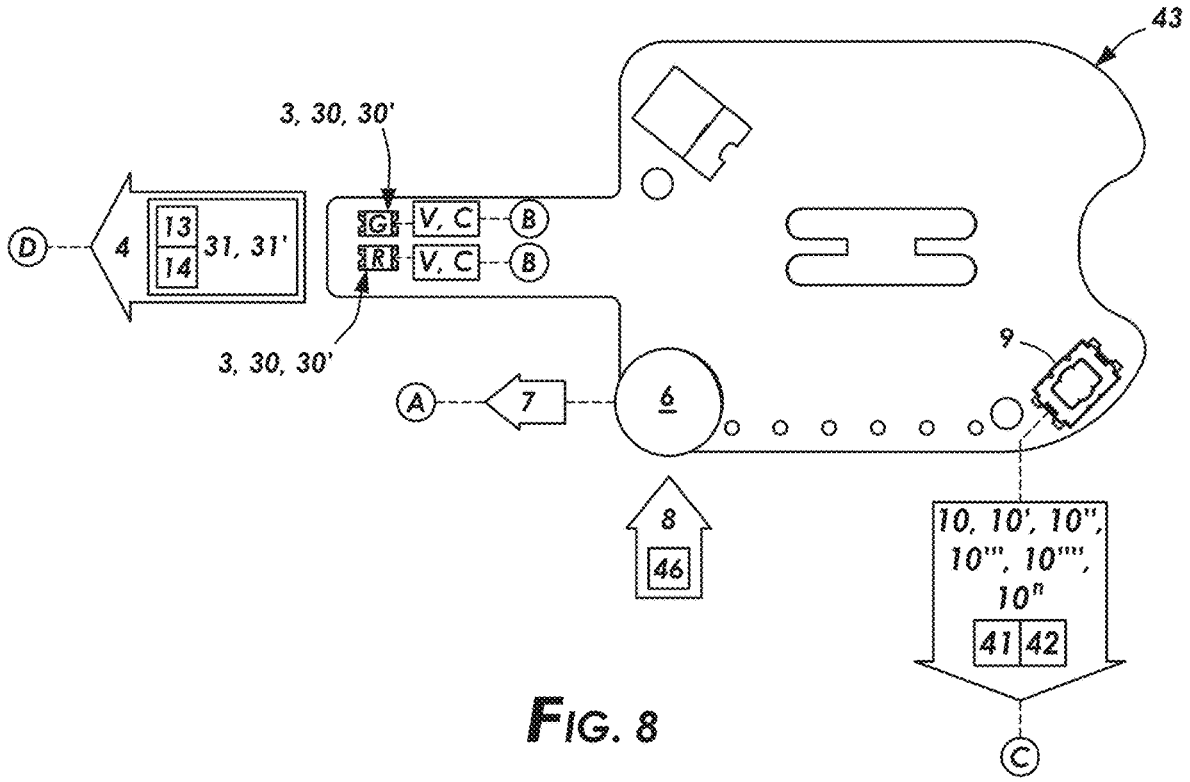
FIG. 8 is top plan view of an embodiment of a printed circuit board as depicted in FIGS. 3 and 6.
Figure 9:
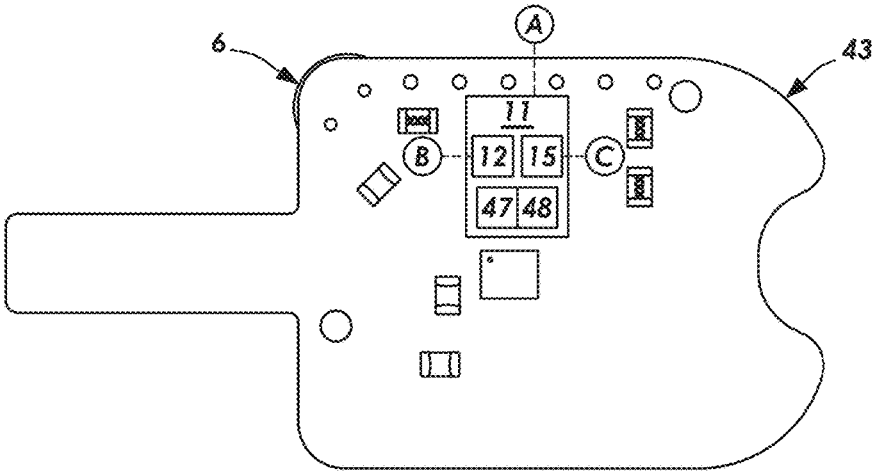
FIG. 9 is a bottom plan view an embodiment of a printed circuit board as depicted in FIGS. 3 and 6.
Figure 10:
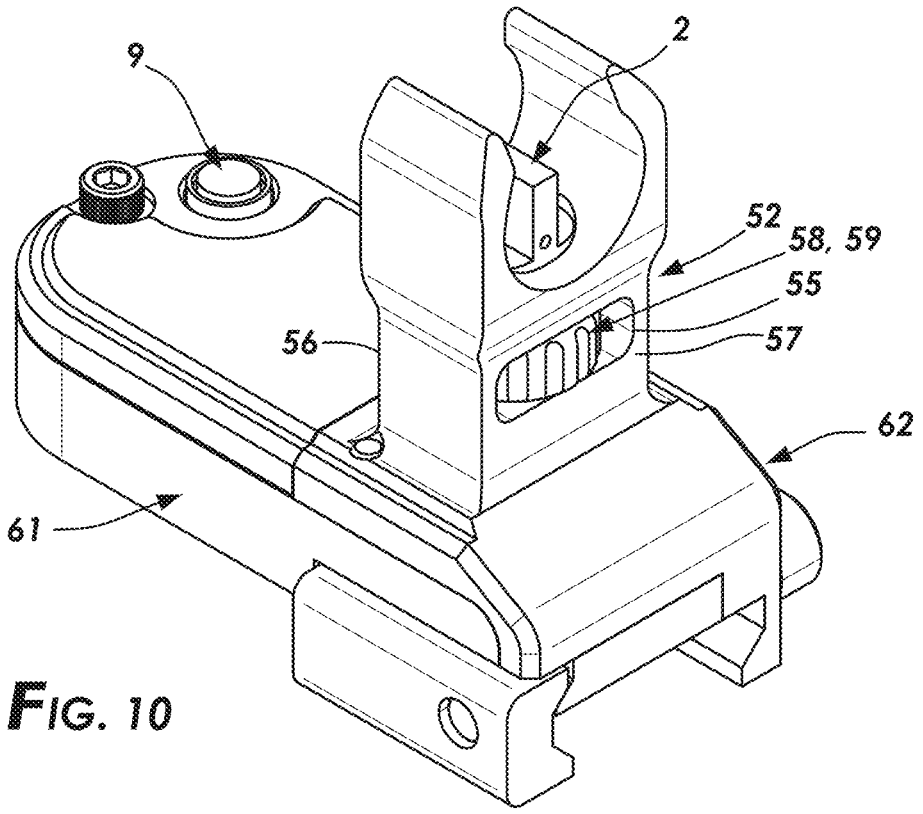
FIG. 10 is top rear first side perspective view of the particular embodiment of the inventive weapon sight depicted in FIG. 2.
Figure 11:
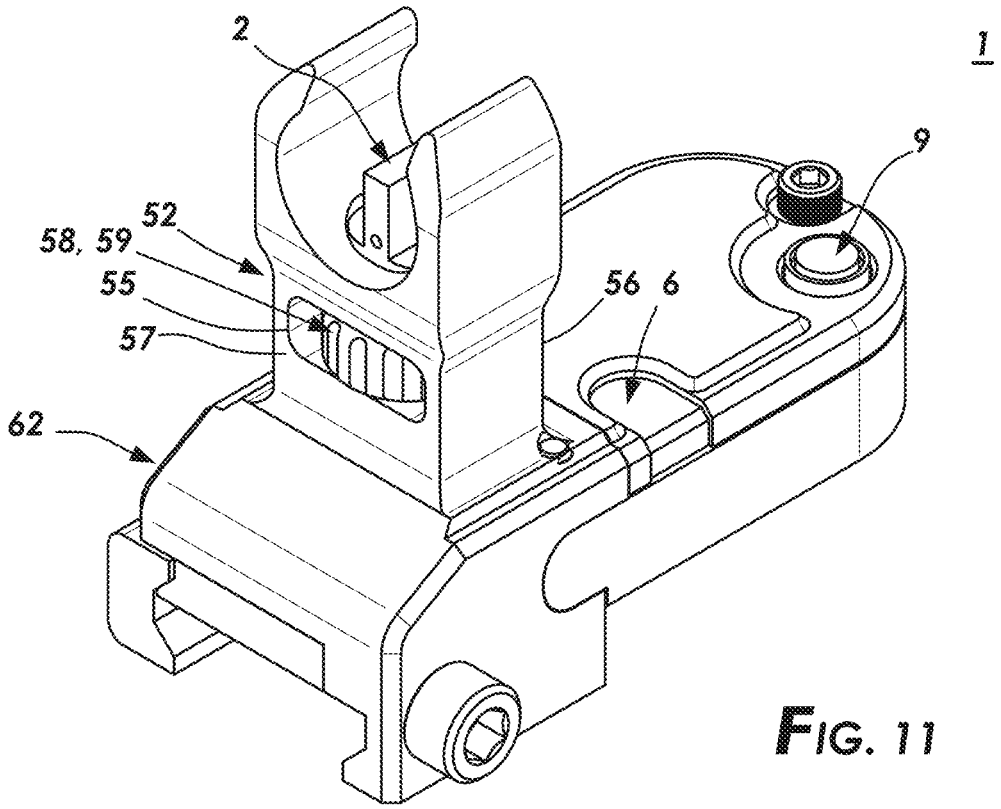
FIG. 11 is top rear second side perspective view of the particular embodiment of the inventive weapon sight depicted in FIG. 2.
Figure 12:
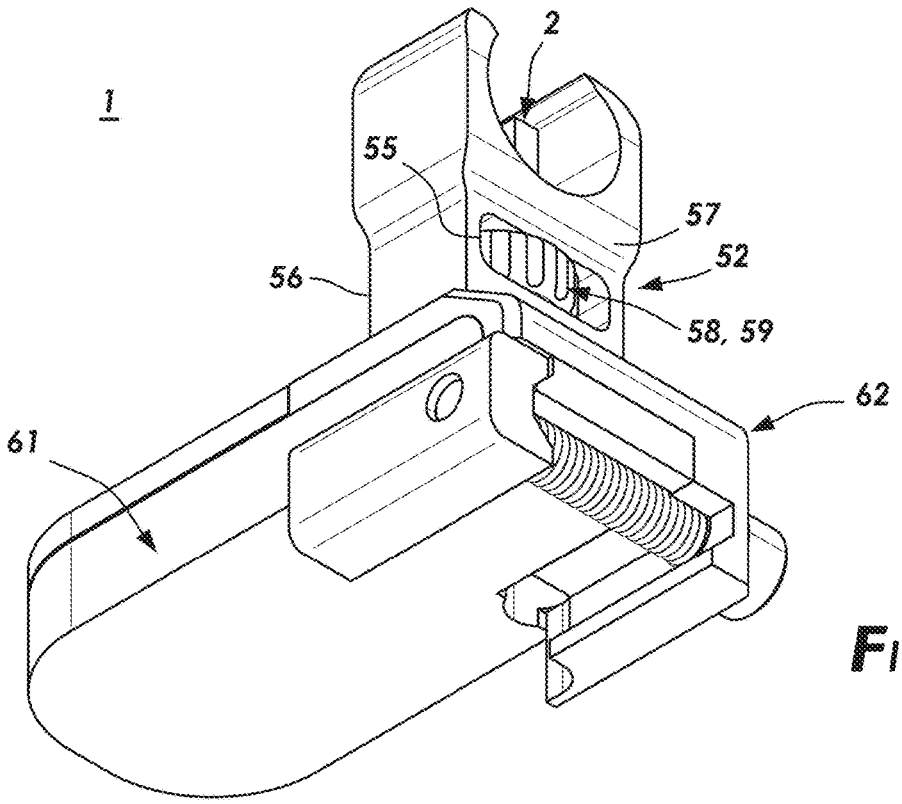
FIG. 12 is bottom rear first side perspective view of the particular embodiment of the inventive weapon sight depicted in FIG. 2.
Figure 13:
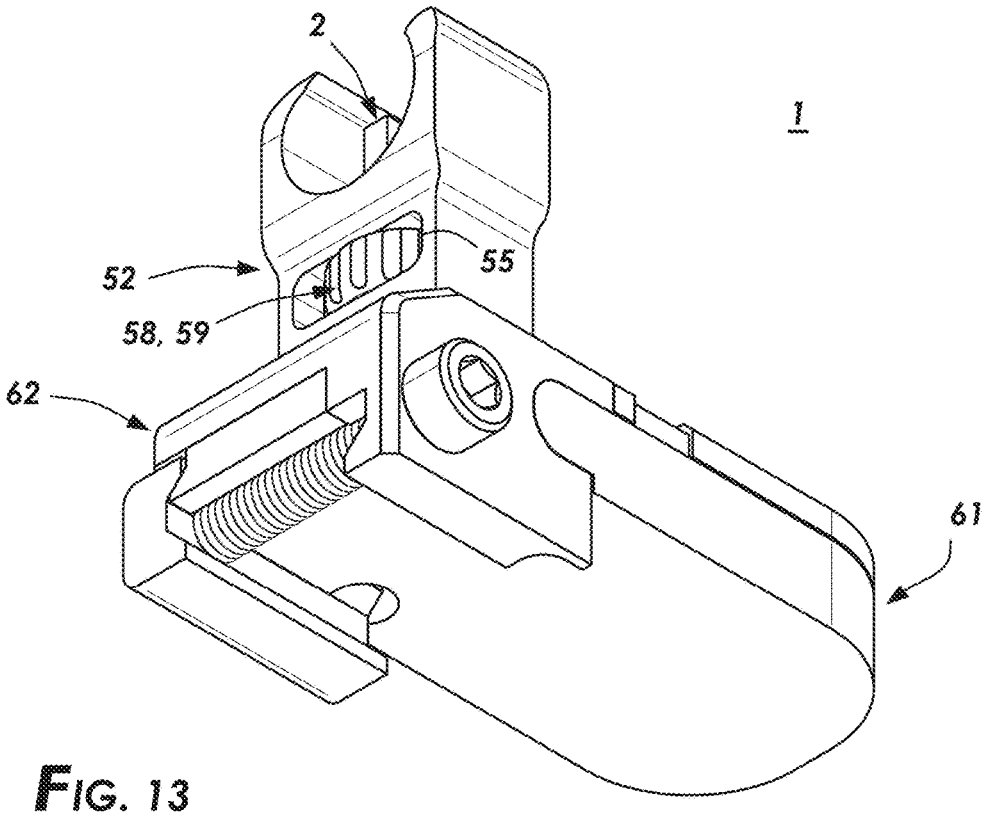
FIG. 13 is a bottom rear second side perspective view of the particular embodiment of the inventive weapon sight depicted in FIG. 2.
Figure 14:
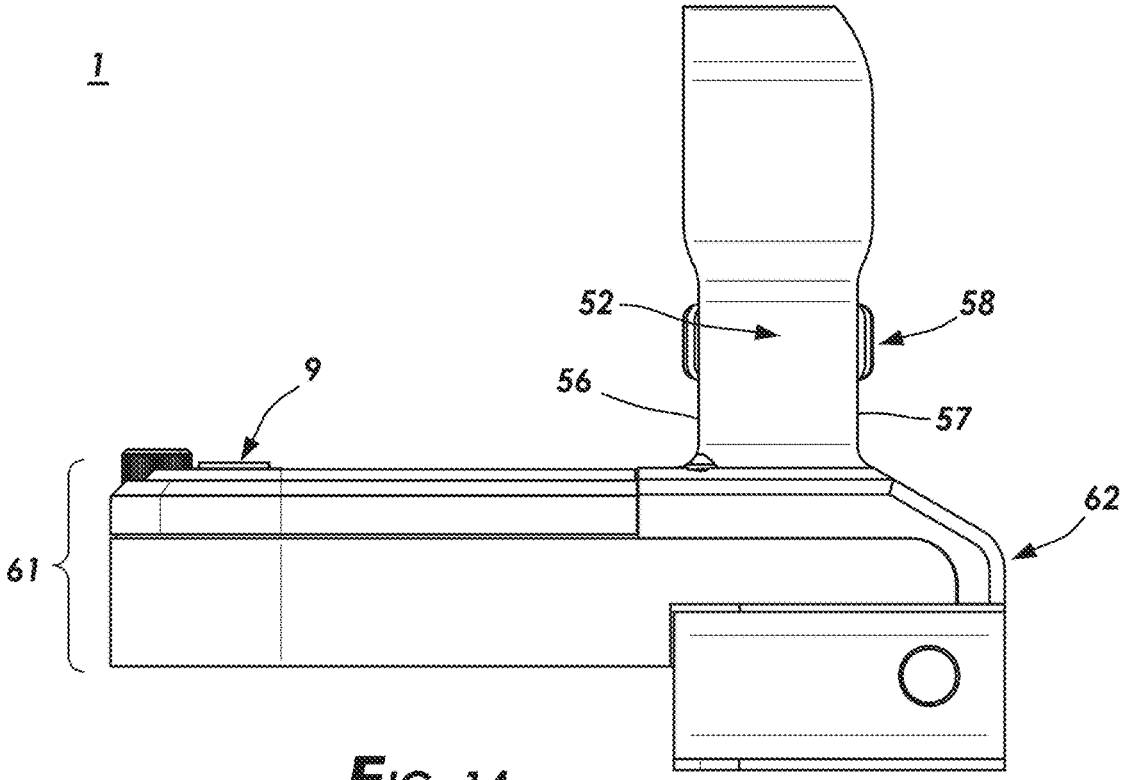
FIG. 14 is first side elevation view of the particular embodiment of the inventive weapon sight depicted in FIG. 2.
Figure 15:
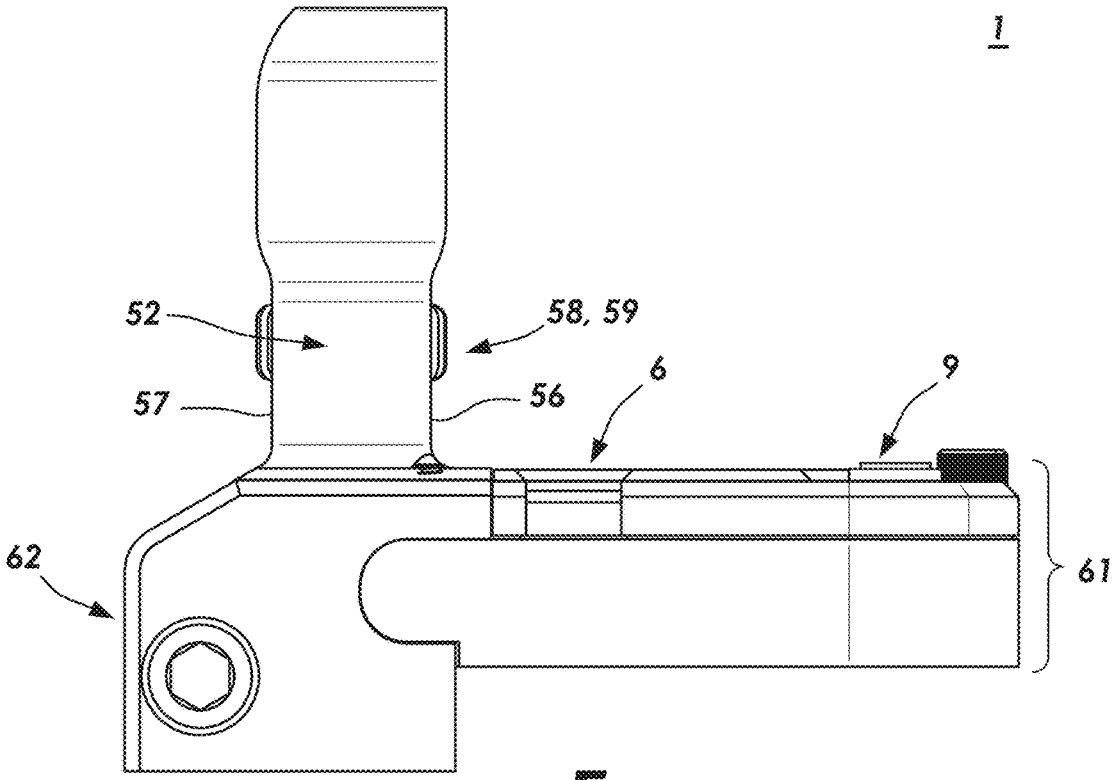
FIG. 15 is second side elevation view of the particular embodiment of the inventive weapon sight depicted in FIG. 2.
Figure 17:
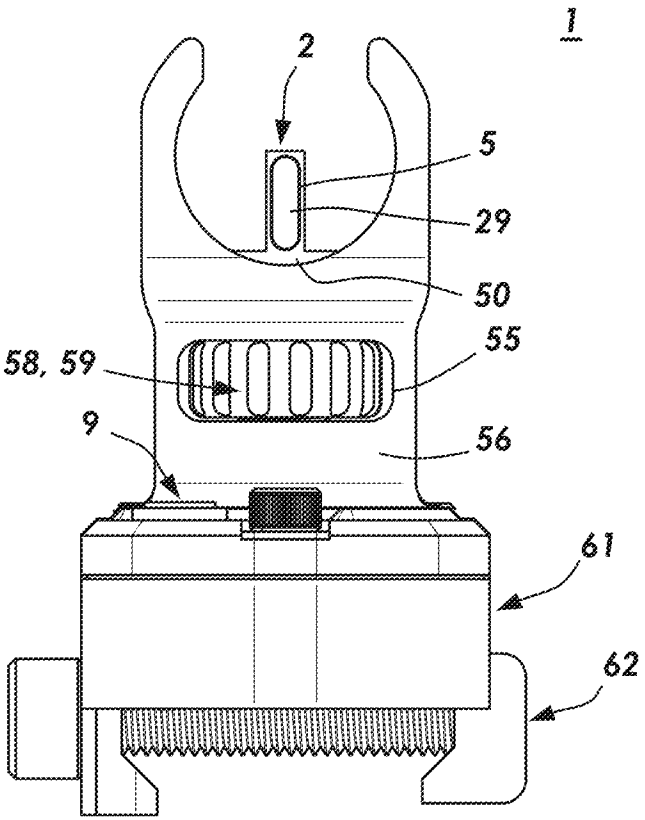
FIG. 17 is front elevation view of the particular embodiment of the inventive weapon sight depicted in FIG. 2.
Figure 16:
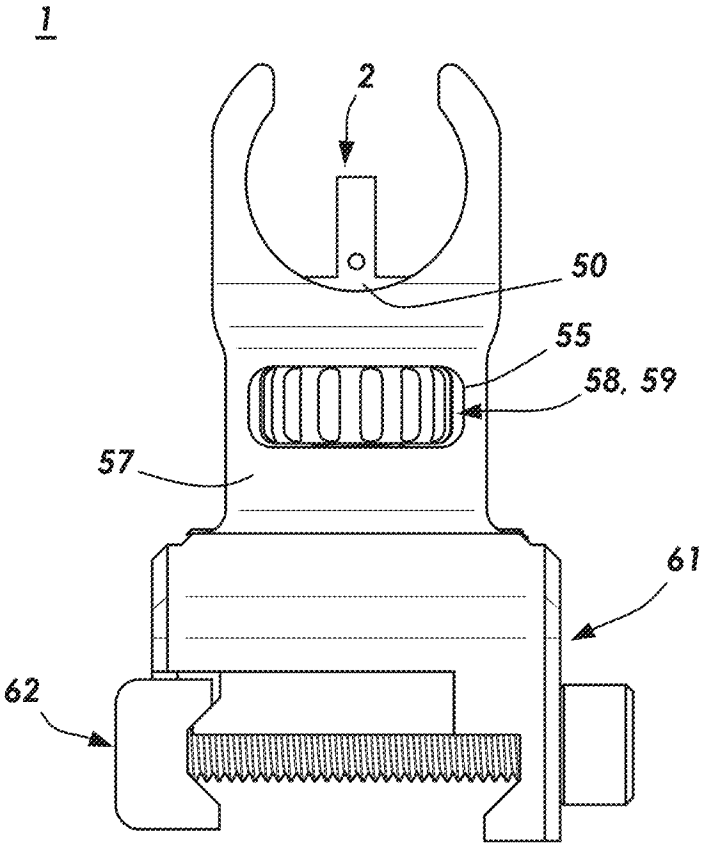
FIG. 16 is rear elevation view of the particular embodiment of the inventive weapon sight depicted in FIG. 2.
Figure 19:
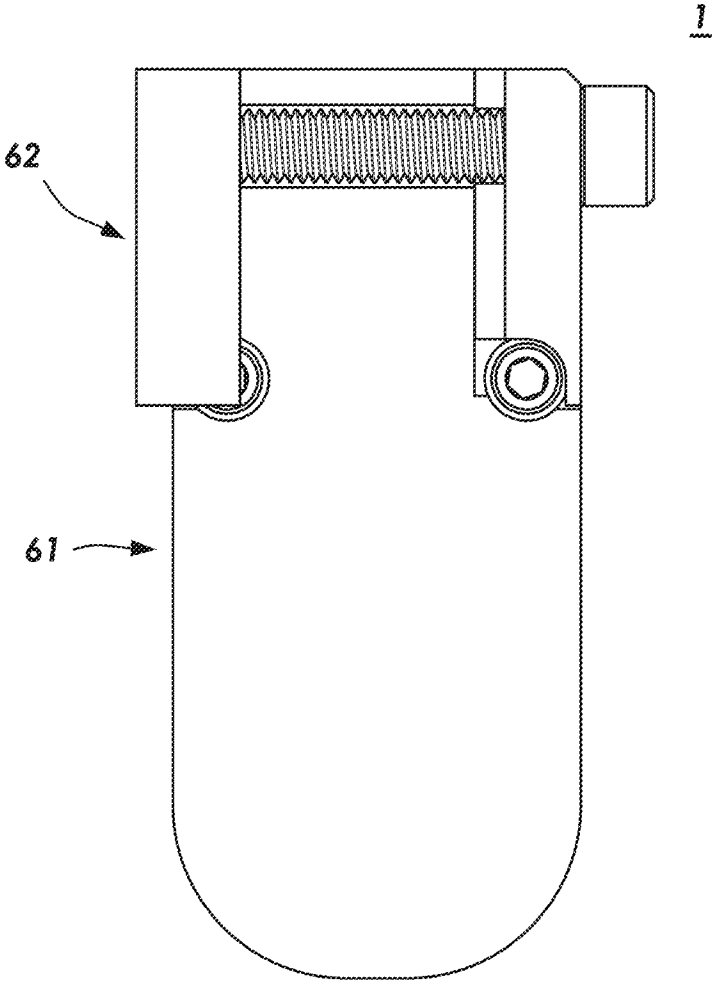
FIG. 19 is a bottom plan view of the particular embodiment of the inventive weapon sight depicted in FIG. 2.
Figure 18:
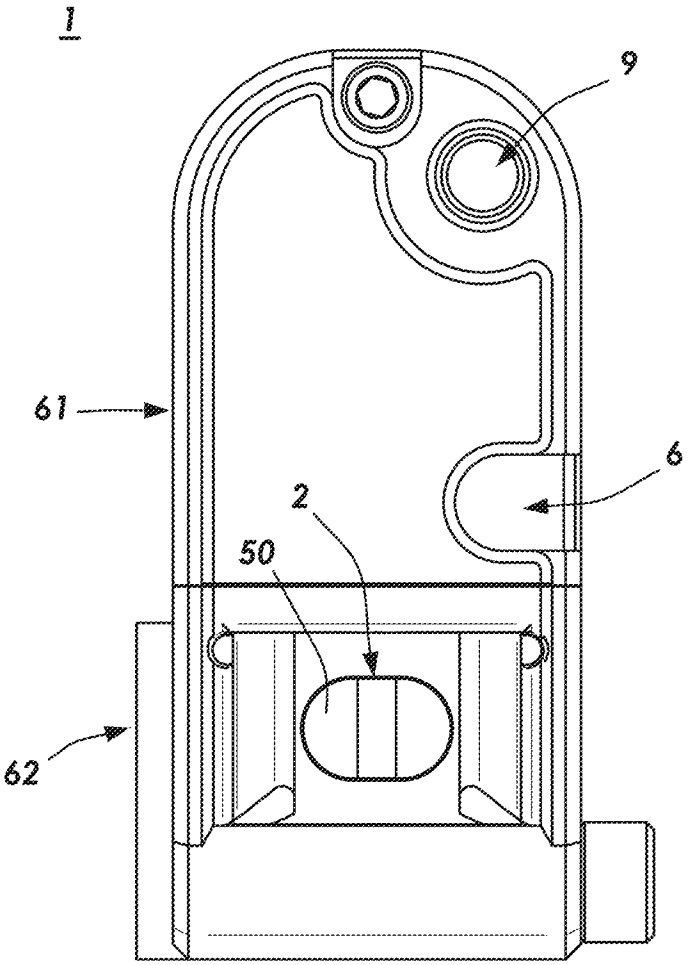
FIG. 18 is a top plan view of the particular embodiment of the inventive weapon sight depicted in FIG. 2.

Now, with primary reference to FIGS. 3 and 4, in particular embodiments, the light source (3) can comprise a radionuclide which emits beta radiation, such as a tritium gas-filled capsules (44) having capsule inner surfaces coated with a dopant or phosphor activated by beta radiation emitted by the tritium. The tritium capsule (44) emits light (4) without any other power source. The tritium capsule (44) can be disposed directly in the hollow interior (24) of the blade (5) to emit light through the blade aperture (5). Typically, the tritium capsule (44) is disposed in a protective container (45) sufficiently transparent to allow light (4) to pass through the protective container (45) to be viewed at blade aperture (5). In particular embodiments, the light pipe first end (39) can be disposed between the tritium capsule (44) and the blade aperture (5). The light (4) emitted by the tritium capsule (44) can be internally reflected within the light pipe first end (39) to provide a constant and consistent luminosity throughout the light pipe first end (39) which can be viewed through the blade aperture (5).

The various light sources (3) above described and shown in the Figures can be used separately or in various combinations to emit light (4) through the blade aperture (5).

Now, with primary reference to FIGS. 1-9, in particular embodiments, the PCB (43) can, but need not necessarily, carry a photosensor (6) positioned to receive ambient light (8). The photosensor (6) can operate to generate a photosensor signal (7) which varies based on ambient light intensity (46) of incident ambient light (8). The PCB (43) can include an integrated circuit including a microprocessor (11) electrically connected to the photosensor (6) and one or more light emitter drivers (12) that operably regulate voltage (V) and current (I) to the light emitters (30) to adjust the emitted light intensity (13) and the emitted light color (14) of the light (4) emitted by the light emitter (30). The microprocessor (11) converts the photosensor signal (7) to ambient light intensity values (47) which can be correlated with ambient light intensity thresholds (48) to determine the corresponding the voltage (V) and current (I) delivered to the light emitters (30) to adjust emitted light intensity (13) and/or emitted light color (14) emitted by the light emitter (30) based on sensed ambient light intensity (46) of the ambient light (8). As illustrative examples, the microprocessor (11) can automatically operate the light emitter driver (12) to increase emitted light intensity (13) emitted by the light emitter (30) as the ambient light intensity (46) of the ambient light (8) increases and can operate to decrease emitted light intensity (13) emitted by the light emitter (30) as ambient light intensity (46) decreases. In particular embodiments, the microprocessor (11) can alter emitted light color (14) by the light emitter (30) from a green color when ambient light intensity (13) occurs above an ambient light intensity threshold (48) and to a red color below the ambient light intensity threshold (48).

Again, with primary reference to FIGS. 1 through 9, in particular embodiments, the PCB (43) can, but need not necessarily, carry a switch (9) operable by a user (16) to generate one or more a switch sequence pattern(s) (10). A "switch sequence pattern" refers to a defined order in which different modes, states or actions of the weapon sight (1) are activated by operation of a switch mechanism to transition between the different modes, states or actions. The microprocessor (11) can include a switch sequence pattern translator (15) which converts the switch sequence patterns (10, 10', 10", 10''', 10'''' . . . 10$^{n}$) to logical steps to operate the light emitter driver (12) to adjust emitted light intensity (13) and/or emitted light color (14) emitted by the light emitter (30). As illustrative examples, a first switch sequence pattern (10') can activate electrical components of the weapon sight (1), a second switch sequence pattern (10") can adjust emitted light color (14) of light (4) emitted by the light emitter (30) within the visible light spectrum (31'), a third switch sequence pattern (10''') can toggle between a green color (G) and a red color (R) emitted light color (14), a fourth switch sequence pattern (10'''') can adjust emitted light intensity (13) of light (4) emitted by the light emitter (30). While the example, uses the terms "first", "second", "third" and "fourth", this is not intended limit the number switch sequence patterns or to fix the order in which switch sequence patterns (10) are entered or used by a user (16) of the weapon sight (1). In particular embodiments, the switch sequence pattern (10) associated with a mode can be altered by the user (16).

Again, with primary reference to FIGS. 2 through 6, embodiments of the weapon sight (1) can further include a power source (49) electrically connected to the integrated circuit of the PCB (43). As an illustrative example, the power source (49) can comprise one or more a batteries (49'), such as LiCB CR202 3 Volt battery as shown in the Figures; however, this example is not intended to preclude other types or configurations of power sources (49), such as: as a solar cells, alkaline batteries, lithium polymer batteries, lithium iron phosphate batteries, alternating current converted to direct current with a power converter, and combinations thereof.

Now, with primary reference to FIGS. 2 through 7, embodiments of the inventive weapon sight (1) can further include a blade shaft (50) coupled to the blade (5). The blade shaft (50) supports the blade (5) in the weapon sight (1). The blade shaft (50) can be received within an interior passageway (51) of a base (52). The blade shaft (50) and the blade base (52) can be configured to allow the blade shaft (50) to adjustably move within the interior passageway (51) of the base (52) to adjust position of the blade (5) to correspondingly adjust the sight axis (18). The blade shaft (50) can comprise a cylindrical three dimensional solid and the corresponding base interior passageway (51) can comprise an open cylinder passageway configured to receive the cylindrical blade shaft. The blade shaft external surface (53) and the open cylinder passageway surface (54) can be structured with mateable threads or gears operable to move the blade shaft (50) in relation to the base (52).

In particular embodiments, a base window (55) can be disposed in the base (52). The base window (55) can open at opposite base sides (56, 57). The base window (55) can be configured to receive an annular member (58) having an outer concentric surface (59) and an inner concentric surface (60). The annular member (58) can be disposed in the base window (55) with the inner concentric surface (60) positioned to engage the blade shaft (50) disposed in the interior passageway (51) of the base (52). The annular member (58) can be rotated whereby rotation of the inner concentric surface (60) moves the blade shaft (50) in the base interior passageway (51). In particular embodiments, the inner concentric surface (60) of the annular member (58) threadingly engages the blade shaft (50), wherein rotation of the inner concentric surface (60) moves the blade shaft (50) in the base interior passageway (51).

Again, with primary reference to FIGS. 1 through 19, a housing assembly (61) can be configured to receive and bear in operable relation the base (52), the printed circuit board (43), the photosensor (6), and the switch (9).

Again, with primary reference to FIGS. 1 through 19, a mount (62) can be coupled to the base (52) and the housing assembly (61). The mount (62) can be configured to affix the weapon sight (1) to a weapon (17).

As can be easily understood from the foregoing, the basic concepts of the present invention may be embodied in a variety of ways. The invention involves numerous and varied embodiments of a weapon sight (1) and methods for making and using such weapon sight (1).

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "light emitter" should be understood to encompass disclosure of the act of "emitting light"—whether explicitly discussed or not—and, conversely, were there effectively disclosure of the act of "emitting light", such a disclosure should be understood to encompass disclosure of a "light emitter" and even a "means for lighting". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Additionally, for the purposes of the present invention, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the weapon sights herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The elements following an open transitional phrase such as "comprising" may in the alternative be claimed with a closed transitional phrase such as "consisting essentially of" or "consisting of" whether or not explicitly indicated the description portion of the specification.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A weapon sight, comprising:

a blade including a blade external surface and a blade internal surface delimiting a hollow interior;

a blade aperture disposed in a blade front face open between said blade internal surface and said blade external surface;

a light pipe disposed within said hollow interior of said blade, said light pipe having a light pipe external surface disposed between a light pipe first end and a light pipe second end, said light pipe external surface disposed adjacent said blade aperture;

one or more light emitters disposed proximate said light pipe second end, said one or more light emitters operable to emit light to illuminate said light pipe external surface;

a photosensor positioned to sense ambient light, said photosensor operable to generate a photosensor signal which varies based on ambient light intensity; and a microprocessor including a light emitter driver electrically connected to said one or more light emitters, said light emitter driver operable to adjust light intensity or light color of said light emitted by said one or more light emitters based on said ambient light intensity.

2. The weapon sight of claim 1, wherein said light pipe comprises a light conductive material including one or more dopants.

3. The weapon sight of claim 1, further comprising a tritium capsule disposed in said hollow interior of said blade adjacent said light pipe, said tritium capsule having a capsule inner surface coated with a dopant or a phosphor and containing a tritium gas, wherein said dopant or said phosphor activated by beta radiation emitted by said tritium gas emits light to illuminate said light pipe external surface.

4. The weapon sight of claim 1, wherein said one or more light emitters is configured to emit said light having a wavelength within a range of about 100 nanometers to about 1 millimeter.

5. The weapon sight of claim 4, wherein said one or more light emitters is configured to emit said light having a green color or a red color.

6. The weapon sight of claim 1, wherein said one or more light emitters is configured to emit said light having an adjustable light wavelength within a range of about 100 nanometers to about 1 millimeter.

7. The weapon sight of claim 1, wherein said one or more light emitters is configured to emit said light having an adjustable light intensity.

8. The weapon sight of claim 1, wherein said one or more light emitters comprises one or more light emitting diodes.

9. The weapon sight of claim 1, further comprising: a switch operable to generate a switch sequence pattern, said microprocessor further including: a switch sequence pattern translator which converts said switch sequence pattern to logical steps to operate said light emitter driver to adjust said light intensity or said light color of said light emitted by said one or more light emitters.

10. The weapon sight of claim 9, wherein said switch sequence pattern activates said one or more light emitters.

11. The weapon sight of claim 9, wherein said switch sequence pattern adjusts said light color of said light emitted by said one or more light emitters.

12. The weapon sight of claim 11, wherein said switch sequence pattern toggles between said light having a green color and a red color.

13. The weapon sight of claim 9, wherein said switch sequence pattern adjusts said light intensity of said light emitted by said one or more light emitters.

14. The weapon sight of claim 9, further comprising;

a blade shaft coupled to said blade; and a base having an interior passageway configured to receive said blade shaft, said blade shaft moveable within said interior passageway to adjust a position of said blade aperture.

15. The weapon sight of claim 14, further comprising a base window open at opposite base sides, said base window configured to receive an annular member having an outer concentric surface and an inner concentric surface, said inner concentric surface configured to engage said blade shaft disposed in said interior passageway of said base, wherein rotation of said inner concentric surface moves said blade shaft in said interior passageway of said base.

16. The weapon sight of claim 15, wherein said inner concentric surface of said annular member threadingly engages said blade shaft, wherein rotation of said inner concentric surface moves said blade shaft in said interior passageway of said base.

17. The weapon sight of claim 9, further comprising a printed circuit board which electrically connects in operable relation said microprocessor, said photosensor, said one or more light emitters and said switch.

18. The weapon sight of claim 17, further comprising a housing assembly which bears in operable relation a base, said printed circuit board, said photosensor, and said switch.

19. The weapon sight of claim 18, further comprising a mount coupled to said housing assembly, said mount configured to affix said housing assembly to a weapon.

20. A method of manufacturing a weapon sight, comprising:

producing a blade including a blade external surface and a blade internal surface delimiting a hollow interior;

disposing a blade aperture in a blade front face open between said blade internal surface and said blade external surface;

disposing a light pipe within said hollow interior of said blade, said light pipe having a light pipe external surface disposed between a light pipe first end and a light pipe second end, said light pipe external surface disposed adjacent said blade aperture;

disposing one or more light emitters proximate said light pipe second end, said one or more light emitters operable to emit light to illuminate said light pipe external surface;

positioning a photosensor to receive ambient light, said photosensor operable to generate a photosensor signal which varies based on ambient light intensity; and electrically connecting a microprocessor to said photosensor and said one or more light emitters, said microprocessor including a light emitter driver electrically connected to said one or more light emitters, said light emitter driver operable to adjust light intensity or light color of said light emitted by said one or more light emitters based on said ambient light intensity.

21. The method of claim 20, wherein said light pipe comprises a light conductive material including one or more dopants.

22. The method of claim 20, further comprising disposing a tritium capsule in said hollow interior of said blade adjacent said light pipe.

23. The method of claim 22, wherein said tritium capsule has a capsule inner surface coated with a dopant or a phosphor and containing a tritium gas, wherein said dopant or said phosphor activated by beta radiation emitted by said tritium gas emits light to illuminate said light pipe external surface.

24. The method of claim 20, further comprising configuring said one or more light emitters to emit said light having a wavelength within a range of about 100 nanometers to about 1 millimeter.

25. The method of claim 20, further comprising configuring said one or more light emitters to emit said light having an adjustable light wavelength within a range of about 100 nanometers to about 1 millimeter.

26. The method of claim 25, further comprising configuring said one or more light emitters to emit said light having a green color or a red color.

27. The method of claim 20, further comprising configuring said one or more light emitters to emit said light having an adjustable light intensity.

28. The method of claim 20, further comprising configuring said one or more light emitters as one or more light emitting diodes.

29. The method of claim 20, further comprising electrically connecting a switch to said microprocessor, said switch operable to generate a switch sequence pattern, said microprocessor including a switch sequence pattern translator which converts said switch sequence pattern to logical steps to operate said light emitter driver to adjust said light intensity or said light color of said light emitted by said one or more light emitters.

30. The method of claim 29, further comprising activating said one or more light emitters based on said switch sequence pattern.

31. The method of claim 29, further comprising adjusting said light color of said light emitted by said one or more light emitters based on said switch sequence pattern.

32. The method of claim 29, further comprising toggling between said light having a green color and a red color based on said switch sequence pattern.

33. The method of claim 29, further comprising adjusting said light intensity of said light emitted by said one or more light emitters based on said switch sequence pattern.

34. The method of claim 29, further comprising:

coupling a blade shaft to said blade; and producing a base having an interior passageway configured to receive said blade shaft, said blade shaft moveable within said interior passageway to adjust a position of said blade.

35. The method of claim 34, further comprising disposing a base window in said base, said base window open at opposite base sides, said base window configured to receive an annular member having an outer concentric surface and an inner concentric surface, said inner concentric surface configured to engage said blade shaft disposed in said interior passageway of said base, wherein rotation of said inner concentric surface moves said blade shaft in said interior passageway of said base.

36. The method of claim 35, further comprising threadingly engaging said inner concentric surface of said annular member and said blade shaft, wherein rotation of said inner concentric surface moves said blade shaft in said interior passageway of said base.

37. The method of claim 29, further comprising electrically connecting in operable relation said microprocessor, said photosensor, said one or more light emitters and said switch on a printed circuit board.

38. The method of claim 37, further comprising bearing in operable relation said a base, said printed circuit board, said photosensor, and said switch in a housing assembly.

39. The method of claim 38, further comprising coupling a mount to said housing assembly, said mount configured to affix said housing assembly to a weapon.

* * * * *